US007621858B2

(12) United States Patent
Sheron

(10) Patent No.: US 7,621,858 B2
(45) Date of Patent: Nov. 24, 2009

(54) APPARATUS AND METHOD FOR EXERCISE USING AN OMNIDIRECTIONAL ROLLER

(76) Inventor: Aileen Sheron, 12401 Vista Panorama, Santa Ana, CA (US) 92705

( * ) Notice: Subject to any disclaimer, the term of this patent is extended or adjusted under 35 U.S.C. 154(b) by 495 days.

(21) Appl. No.: 11/086,865

(22) Filed: Mar. 21, 2005

(65) Prior Publication Data

US 2005/0209072 A1 Sep. 22, 2005

Related U.S. Application Data

(60) Provisional application No. 60/554,979, filed on Mar. 19, 2004.

(51) Int. Cl.
*A63B 21/00* (2006.01)

(52) U.S. Cl. ..... 482/132; 482/129

(58) Field of Classification Search ..... 482/907, 482/132, 148; 16/47, 24–25, 18, 105, 19, 16/14 R See application file for complete search history.

(56) References Cited

U.S. PATENT DOCUMENTS 598,773 A 2/1898 Figge
600,172 A * 3/1898 Rechtsteiner ..... 16/26
970,386 A * 9/1910 Nickerson ..... 16/26
2,719,043 A * 9/1955 Oppenheimer ..... 280/47.11
3,024,021 A 3/1962 Coplin et al.
3,306,626 A 2/1967 Kawada
3,345,675 A * 10/1967 Haydock ..... 16/45
3,809,393 A * 5/1974 Jones ..... 482/132
4,116,233 A 9/1978 Scaduto
4,126,326 A 11/1978 Phillips
4,382,637 A 5/1983 Blackburn et al.
D403,076 S 12/1998 York
5,906,247 A * 5/1999 Inoue ..... 180/20
6,093,159 A 7/2000 Racoosin
6,629,913 B2 * 10/2003 Chen ..... 482/129
6,942,605 B1 * 9/2005 Sukhovitsky ..... 482/132
2002/0098956 A1 7/2002 Rattray

* cited by examiner

*Primary Examiner*—Jerome Donnelly
(74) *Attorney, Agent, or Firm*—O'Melveny & Myers LLP

(57) ABSTRACT

The invention provides an exercise apparatus with a hemispherical support frame and a rigid ball mounted to the support frame with a low-friction bearing system in between the ball and the support frame so that the ball is freely rotatable in any direction. In one embodiment, the bearing system comprises a plurality of ball bearings and a retainer. The present invention also provides for an exercise system with two omnidirectional rolling apparatuses and a band that tethers the pair of apparatuses. The present invention also provides for methods of using the apparatus and system to perform isotonic exercises.

11 Claims, 11 Drawing Sheets

APPARATUS AND METHOD FOR EXERCISE USING AN OMNIDIRECTIONAL ROLLER

CROSS-REFERENCE TO RELATED APPLICATION

This application claims priority pursuant to 35 U.S.C. § 119(c) to U.S. Provisional Patent Application Ser. No. 60/554,979, filed Mar. 19, 2004, which application is specifically incorporated herein, in its entirety, by reference.

BACKGROUND OF THE INVENTION

1. Field of the Invention

The present invention relates to an apparatus and method for isotonic exercise as used in strength training, and more particularly, to exercise performed using a rolling apparatus.

2. Description of Related Art

Isotonic exercise involves the movement of a body part against resistance. Different isotonic exercise methods are known in the art. Some methods, for example, push-ups and sit-ups, make no use of exercise equipment. Other methods make use of equipment, such as barbells, tension bands, springs, or rollers. Such equipment is often used to increase the resistance or level of difficulty of the workout, such as to achieve superior strength conditioning more quickly.

Some methods of isotonic exercise involve the use of a roller incorporated into exercise equipment. Typically, the user performs an exercise by moving the roller over a track in a back-and-forth motion, working against a spring or gravitational force. Movement of the roller against a resistance permits a cycle of contraction and extension for the desired muscle group. Muscle groups that are sometimes conditioned this way include abdominal, back, arm, and leg muscles. Rolling apparatus, for example, roller skates and skateboards, are also used as play or sports equipment, but such uses are distinct from isotonic exercise.

Although methods and apparatus for isotonic exercise using rollers are beneficial for strength conditioning, they are subject to certain limitations. After a period of use, a user may become bored with the repetitious back-and-forth motion used in rolling exercise. Certain muscle groups may be difficult to exercise using a traditional rolling apparatus, for example, it may be difficult or impossible to achieve a desired relationship between a path of motion of the roller, and a muscle group to be exercised. It may be desirable to exercise a wider range of muscle groups using a single exercise than is possible with a conventional roller. For example, it may be desirable to perform a more complex, motion cycle using a rolling apparatus. A more complex motion may be used to involve a greater number of muscle groups in a particular exercise. In addition, a more complex motion can be used to develop both muscle coordination and strength with a single exercise. A back-and-forth rolling apparatus may place undesirable constraints on the performance of these more complex exercises.

It is desirable, therefore, to provide an apparatus and method for performing an isotonic exercise that overcomes the limitations of the prior art.

SUMMARY OF THE INVENTION

The present invention provides a method and apparatus for performing isotonic exercise using an omnidirectional roller. While omnidirectional rollers are known in other fields, for example, as massage aids or material handling equipment, they have not heretofore been successfully adapted for use in isotonic exercise as described herein.

According to an embodiment of the invention, one or more omnidirectional roller units are provided for use in exercise. Each roller unit comprises one or more spherical rollers mounted to a support frame using any suitable low-friction bearing, such as a ball bearing. A gripping surface may be provided over the support frame, with a portion of the spherical roller or rollers exposed under the gripping surface and configured for rolling over a support surface. A strap or other suitable retaining member may be provided over the gripping surface, configured for insertion of a user's hand, knee, or foot between the gripping surface and the strap or other retaining member. In an embodiment of the invention, the gripping surface is substantially hemispherical and of a size suitable for gripping by hand. The gripping surface may comprise a cushioned material or hard material.

To use the omnidirectional roller, a user supports a portion of her body over a support surface using the rolling surface of the roller as a point of support. The gripping surface of the rolling unit may be grasped by the user's hand under the strap, or simply strapped at any other suitable location, such as to the user's foot. Then, while continuing to support a part of her body using the rolling unit, the user rolls the rolling unit in any desired path over the support surface. In particular, the rolling motion may be performed over a curved or angular path, thereby involving a greater number of muscle groups than a linear back-and-forth stroke. For example, a user may move the roller in an elliptical path over the support surface, while using the roller to support her arm.

Two or more omnidirectional rolling units may be used together during exercise. For example, a user may grasp a rolling unit in each hand, and perform any desired rolling exercise with both hands. Such exercises may be performed using simultaneous or alternating strokes.

In an embodiment of the invention, two or more omnidirectional rolling units may be connected together by an elongated resilient member, such as an elastic band. During exercise, the rolling units may be separated against the resistance provided by the resilient band, thereby providing another source of resistance for isotonic exercise. In addition, or in the alternative, any part of the body may be tethered to the rolling unit via a resilient member. For example, a user's foot may be tethered to the rolling unit using a length of elastic band. Then the user may grasp the rolling unit by the hand and roll it over the support surface, using her foot as an anchor for the elastic tether. In the alternative, a free end of the elastic tether may be attached to a secure attachment point fixed relative to the support surface.

Optionally, the omnidirectional rolling units may be configured for use as free weights, such as hand weights or leg weights. For example, each unit may be made having a suitable weight for use in weight lifting exercises, such as, for example, 3, 5, 7.5, or 10 pounds. Each unit may also be configured as a compact, smooth unit with a handle, strap, or other surface for grasping or attaching as a weight. As such, the rolling units may combine the benefits of hand or foot weights with rollers, in a single exercise device. In an embodiment of the invention, the benefits of both types of exercise equipment are combined in a compact and aesthetically pleasing package. Different weights may be provided for the same unit by substituting rollers of different weights, if desired. In the alternative, the omnidirectional rolling units may be configured as lightweight equipment.

Thus, the invention provides an omnidirectional rolling apparatus for use in exercise, and method of exercising thereby, that overcomes the limitations of the prior art. Using a method and apparatus according to the invention, a user may perform a variety of challenging isotonic exercises providing superior benefits for muscle conditioning and coordination. The apparatus may be used to perform exercises that involve a greater number of muscle groups, and that are more interesting to perform than prior art isotonic rolling exercise. Further, an apparatus according to the invention may be provided in a compact, relatively inexpensive, and aesthetically pleasing configuration that enhances its value and appeal to consumers. The value of the apparatus may be further enhanced by configuring as free weights, and/or by rolling against the resistance provided by an attached tether.

A more complete understanding of the method and apparatus for performing isotonic exercise using an omnidirectional roller will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides an apparatus and method for exercising using an omnidirectional roller that overcomes the limitations of the prior art. In the detailed description that follows, like numerals are used to denote like elements appearing in one or more of the figures.

Figure 1:
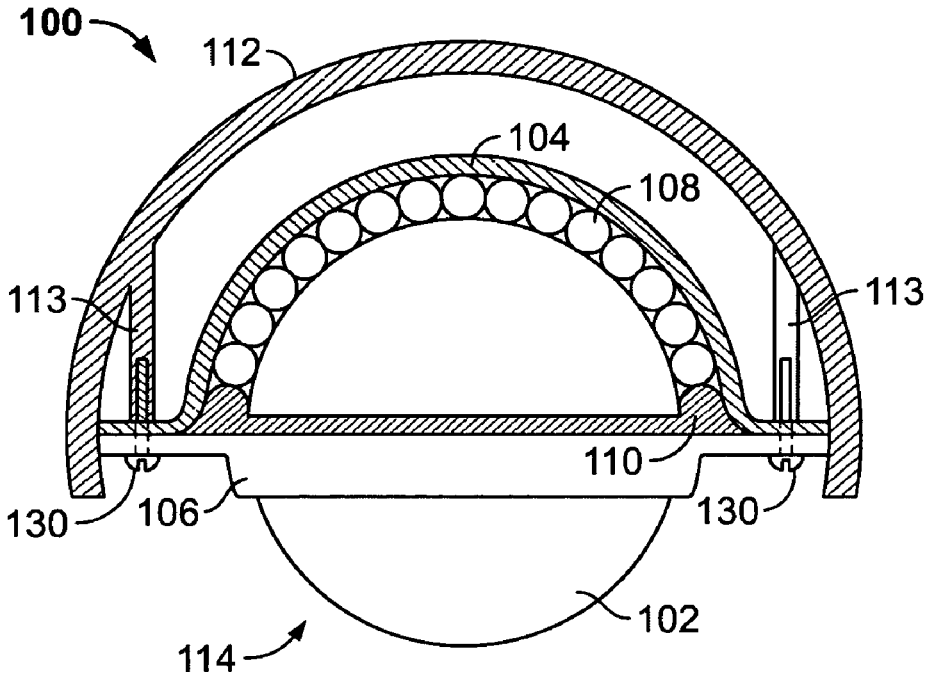
FIG. 1 is a cross-sectional schematic showing an exemplary omnidirectional rolling device or apparatus according to the invention.

Referring to FIG. 1, an exemplary omnidirectional exercise roller 100 is depicted in a partial cross-sectional view. FIG. 1 shows a single-ball roller; it should be apparent to one of ordinary skill that a multi-ball design may also be suitable. Roller apparatus 100 comprises an omnidirectional roller ball 102 formed of any suitable structural material, such as, for example, polyamide, PVC, metal, or the like. Ball 102 may be a solid, hollow, or partially hollow structure. If hollow, its interior may be used to contain a ballast material for achieving a desired weight or feel.

In one embodiment, the ball 102 is mounted between a top cover 104 and a bottom cover 106, which when fastened together provide a bearing race and stationary support frame for ball 102. A low-friction bearing system is preferably placed between the ball 102 and top cover 104. In one embodiment, shown in FIG. 1, the low-friction bearing system comprises a plurality of ball bearings 108 disposed between the ball 102 and top cover 104. It will be understood that the number, size, and spacing of the ball bearings 108 can be varied according to the particular rolling apparatus 100 design. In another embodiment (not illustrated), the bearing system comprises spacers in between the individual ball bearings 108.

Figure 2:
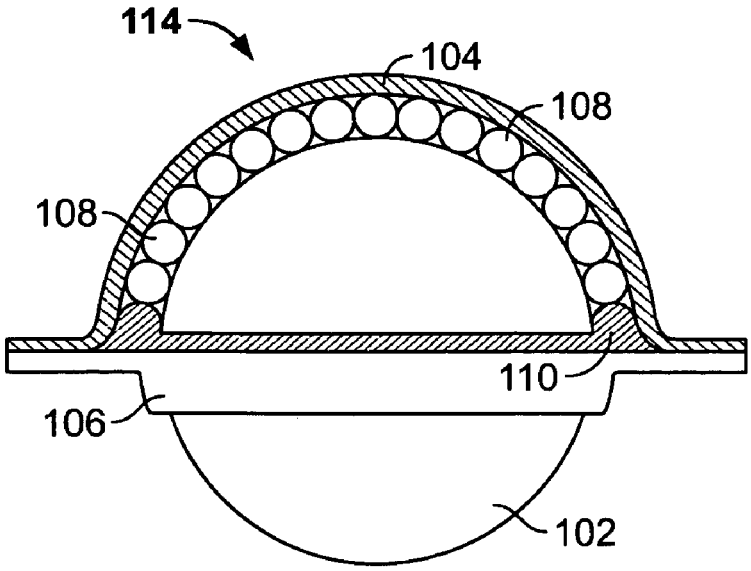
FIG. 2 is a cross-sectional schematic showing an exemplary roller component of the apparatus shown in FIG. 1.

A retainer 110 may be assembled with covers 104, 106 to retain ball bearings 108 relative to the ball 102. Retainer 110 or a separate retainer (not shown) may also be used to maintain a uniform spacing between individual ones of bearings 108, as known in the art. Other configurations for mounting a roller ball so as to provide relatively little rolling resistance when loaded during exercise may also be suitable, and should be apparent to one of ordinary skill in the art. In the embodiment shown in FIGS. 1 and 2, the retainer 110 comprises a spring clip mechanism for retaining the ball bearings 108 relative to the ball 102. In another embodiment (not illustrated), the bearing system comprises a hemispherical plastic retainer into which a plurality of balls are inserted.

It is believed that typical vertical loads on ball 102 during a typical exercise routine may be of the order of approximately 10 to approximately 100 pounds. Together, covers 104, 106, ball 102, and ball bearings 108 comprise a modular rolling unit 114, shown separately in FIG. 2. It may be convenient to make use of the same rolling unit 114 with a variety of different covers or handles, as explained below.

Referring again to the embodiment illustrated in FIG. 1, an outer cover or shell 112 may be assembled over an upper portion of rolling unit 114. The shell 112, which typically comprises two or more standoffs 113, is connected to the rolling unit 114 with screws 113 that traverse covers 104 and 106 and are twisted and secured into standoffs 113. Other suitable fasteners and connectors known in the art can be used to secure the shell 112 to the rolling unit 114.

With continued reference to FIG. 1, in one embodiment, cover 112 comprises a hemispherical plastic shell that is sized for gripping by a user's palm. Optionally, an outer surface of shell 112 may comprise a resilient material with good gripping characteristics, as known in the art. In addition, or in the alternative, an upper surface of shell 112 may be contoured in an ergonomic shape for gripping. In comparison, FIG. 1 shows a more universal hemispherical shape, which advantageously accommodates gripping in a variety of different positions during exercise. The exercise apparatus 100 may thus be provided with a generally spherical appearance that is both aesthetically pleasing and functional. A variety of other appearances and configurations may also be suitable.

For example, shell 112 may be provided in a variety of different shapes and sizes to accommodate different users and different exercises, all of which may make use of an interchangeable rolling unit 114. In addition, the shell 112 may be configured to accommodate different amounts of ballast weights for adjustment of weight when exercise apparatus 100 is used as a free weight. For example, ballast weights (not shown) may be mounted in a space between shell 112 and unit 114.

Figure 3A:
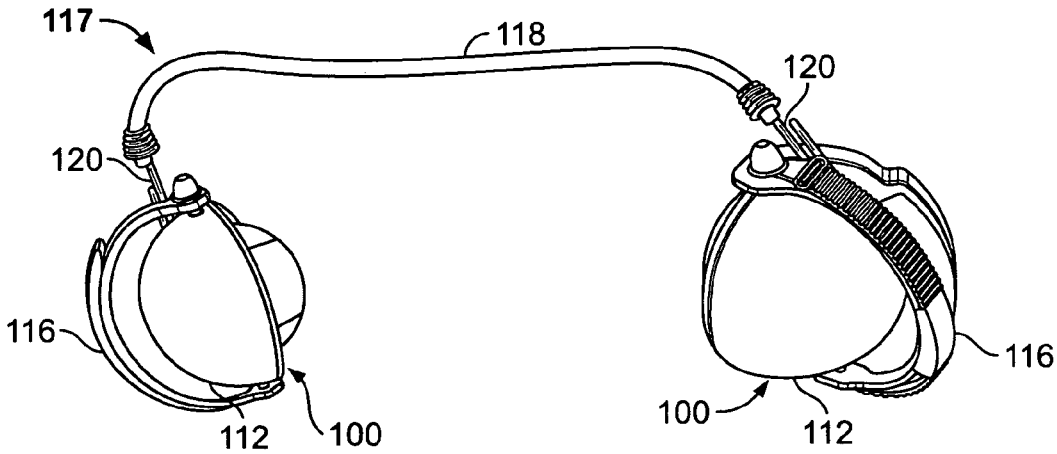
FIG. 3A is a side elevated view of two rolling devices or units connected by an elastic tether.

A retaining member, such as a strap or the like, may be provided over an upper surface of shell 112. FIG. 3A shows two exercise apparatuses 100, each provided with a strap 116 over an upper surface of shell 112. Strap 116 and shell 112 may be configured for inserting a hand, foot, or other body part in between, thereby preventing apparatus 100 from dropping when lifted off of a support surface, and/or helping users maintain a grip on cover or shell 112. Strap 116 is preferably adjustable to accommodate users of different anatomical sizes.

FIG. 3A illustrates how two or more exercise apparatuses 100 may be tethered together using an elongated resilient member, such as elastic band 118, to form a multi-apparatus exercise assembly 117. In the depicted embodiment, band 118 comprises a cargo strap with removable hooks 120 attached at its opposite ends. In one embodiment, the hooks 120 are engaged with corresponding loops provided on the respective apparatus(es) 100, so as to be easily removable. In another embodiment, the hooks 120 are engaged with the straps 116 on the respective rolling apparatuses 100. It should be apparent that a variety of other configurations for member 118 and its attachment to apparatus 100 may also be suitable.

Figure 3B:
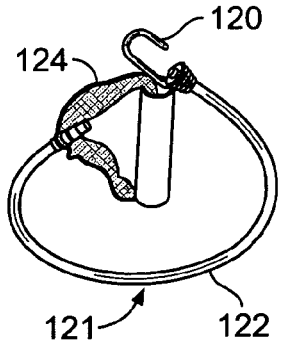
FIG. 3B is a side elevated view of a tether and foot strap that can be connected to a rolling device.

With reference to FIG. 3B, there is provided one embodiment of a band-strap assembly 121 that can be tethered to an omnidirectional roller apparatus 100. The assembly 121 comprises a band 122 that is provided with a foot or hand strap 124 on one end, and a hook 120 at its opposite end. After attaching band 122 to the apparatus 100 with the hook 120 or other suitable attachment, a user may operate the apparatus 100 in opposition to her hand or foot. In another approach, one end of band 122 may be attached to a fixed point relative to the user, such as, for example, to a floor or wall mounted bracket.

Figure 17:
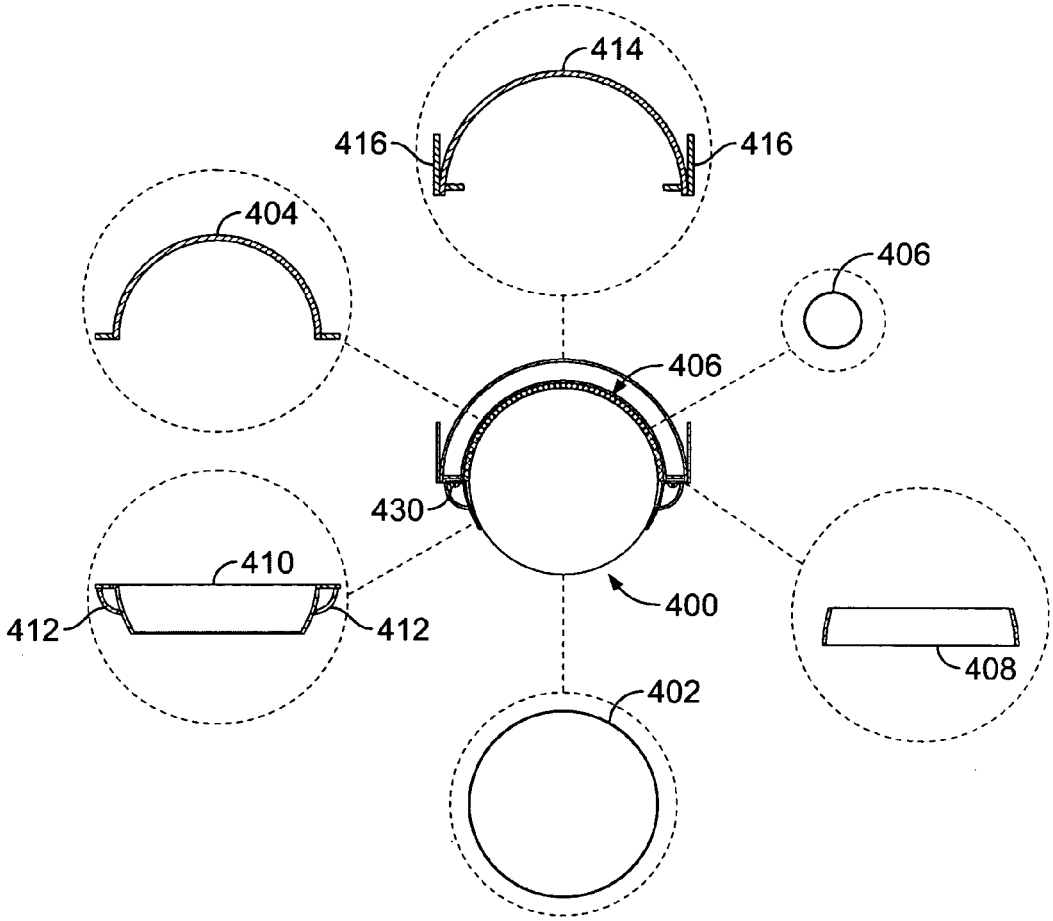
FIG. 17 is an assembly diagram showing a completed assembly and components of an exemplary embodiment of an omnidirectional roller.
Figure 18:
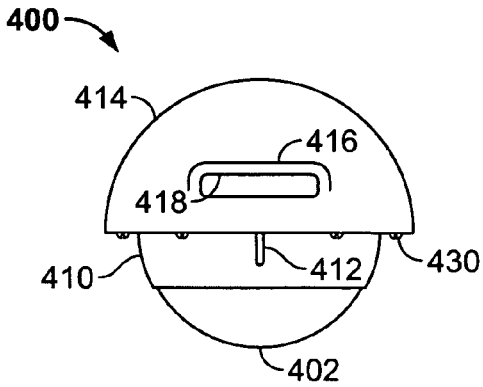
FIG. 18 is a rotated side view of the exemplary roller shown in FIG. 17.

With reference to FIGS. 17 and 18, there is provided another embodiment of an omnidirectional roller 400 that is similar to the roller 100 shown in FIG. 1. Roller apparatus 400 comprises a large roller ball 402 that is mounted partly inside a generally hemispherical inner steel shell 404. A plurality of ball bearings 406 are retained between inner shell 404 and ball 402. A small ball retainer or support 408 is disposed around ball 402 just above the lower opening of shell 404, for retaining the ball bearings 406 inside the shell 404. Bottom steel shell 410 fits over ball 402 and is fastened to shell 404, for retaining ball 402. Bottom shell 410 may be provided with optional loops 412 for attachment of an elastic band as previously described. The inner shell 404 and bottom shell 410 together function as a stationary support frame for ball 402.

An outer shell 414 is assembled to shells 404, 410 over the upper portion of apparatus 400. The outer shell 414 is typically attached to inner shell 404 with two or more screws 430 or other suitable fasteners. In one embodiment, outer shell 414 is chrome plated for a clean and shiny appearance. A pair of opposing side tabs 416 are provided on the outer shell 414, for attachment of an optional strap, explained in further detail below. Each tab 416 comprises a slot 418 for attachment of the strap. A corresponding tab 416 and slot 418 are provided on the opposite side of outer shell 414.

Figure 19:
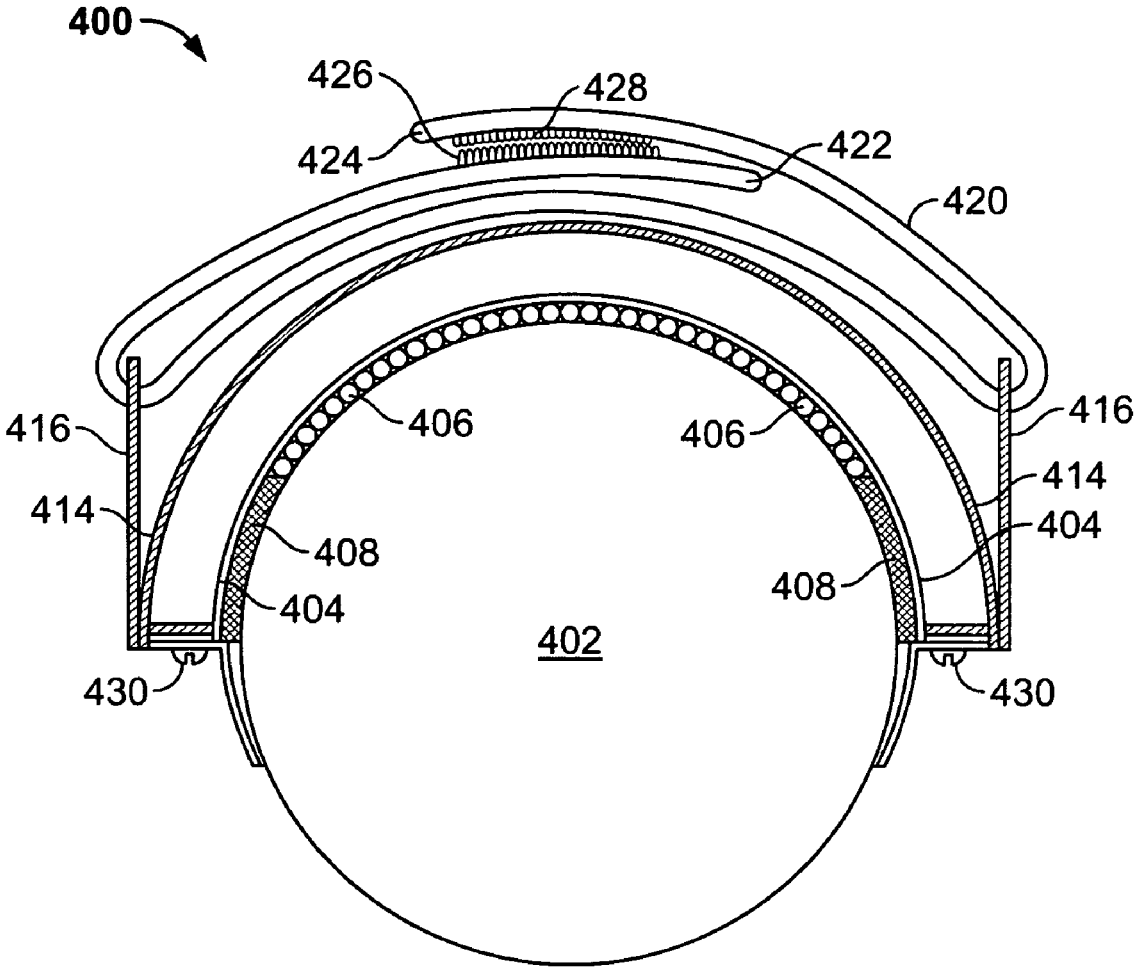
FIG. 19 is a cross-sectional schematic showing another embodiment of an omnidirectional roller having a strap but no loops for attachment of an elastic band.
Figure 20:
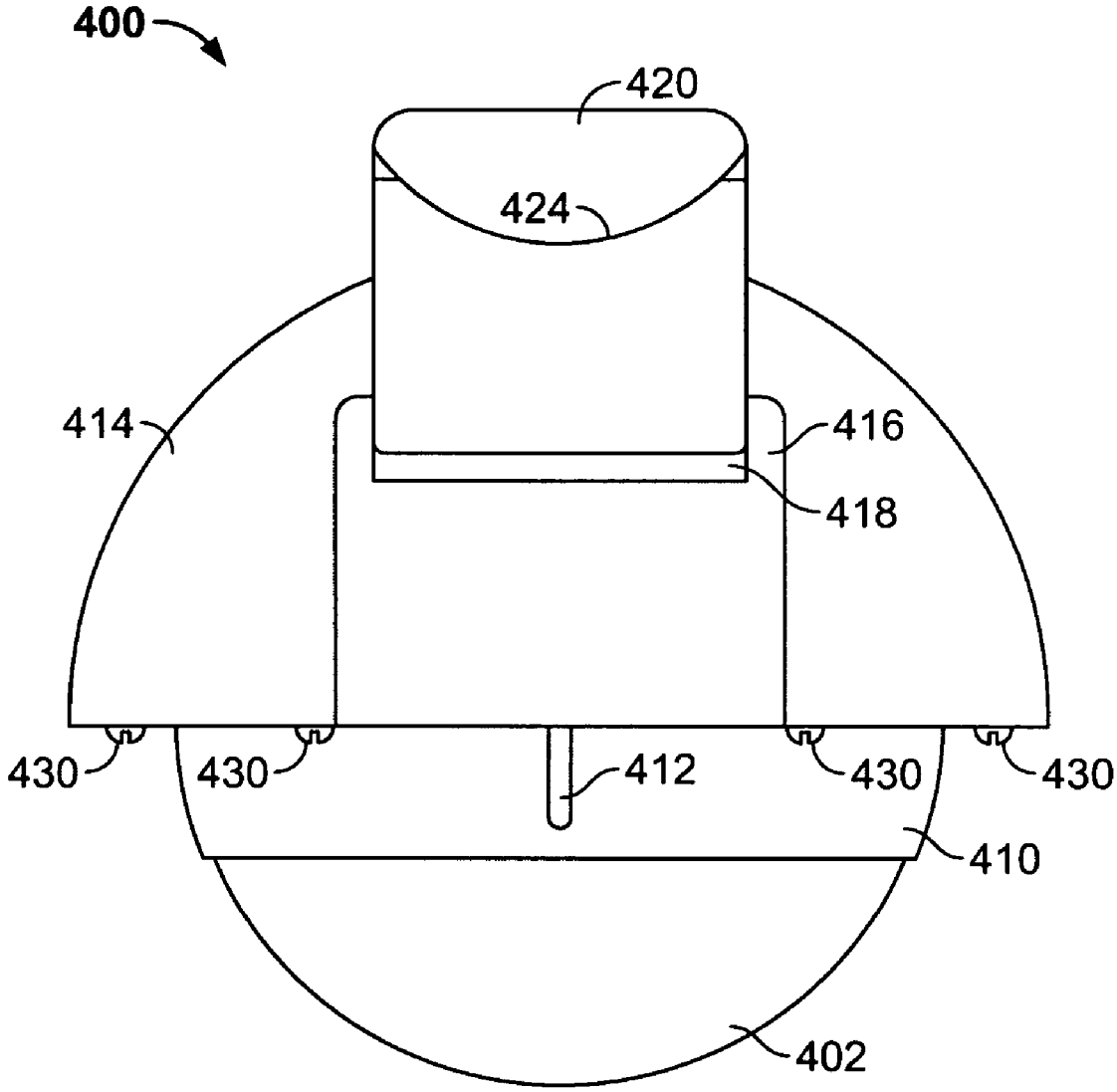
FIG. 20 is a side view of still another embodiment of an omnidirectional roller having a strap, as well as loops for attachment of an elastic band.

With reference to FIG. 19, in another embodiment, the omnidirectional roller 400 does not have loops for attachment of an elastic band. In this embodiment, roller 400 comprises a strap 420 that extends between strap end 422 and strap end 424. The strap 420 loops through the slots 418 in the side tabs 416 and forms a complete loop when complementary fastener pieces 426 and 428 near strap ends 422 and 424, respectively, are connected to each other. In one embodiment, fastener pieces 426 and 428 comprise complementary Velcro-type pieces or the like. The strap 420 functions as a retaining member configured for insertion of a user's hand, knee, foot, or the like either: (1) between the outer shell 414 and the strap 420, or (2) inside the loop formed by the strap 420 when pieces 426 and 428 are connected to each other. With reference to FIG. 20, in yet another embodiment, the roller 400 comprises loops 412 for the attachment of an elastic band or the like, as well as a strap 420.

Figure 4:
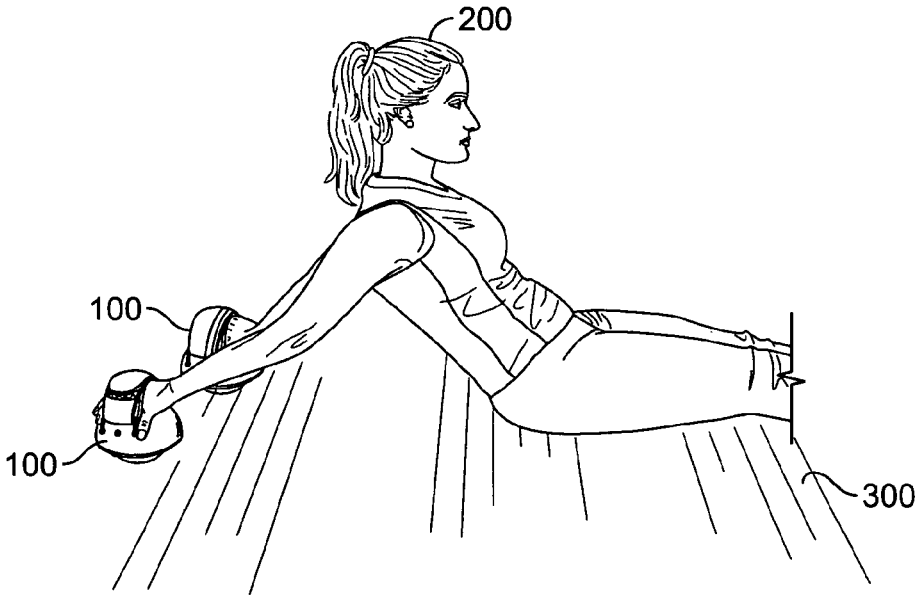
FIG. 4 illustrates one approach to using a rolling device to perform an isotonic exercise.

FIGS. 4-16 illustrate exemplary uses of one or more omnidirectional exercise apparatus(es) 100 to perform different exercises. While the illustrations show the great versatility of an apparatus according to the invention for performing a variety of different exercises, the invention is not limited by any particular pose shown, or by any particular motion that may be inferred from the figures. FIG. 4 shows a user 200 supporting her upper body over a carpeted support surface 300 using an omnidirectional roller 100 in each hand, while leaning back and extending both arms behind her. Such a position may be used, for example, during a symmetrical isotonic sequence. A variety of movements may be accomplished from this position. For example, the rollers 100 may be moved along a semi-elliptical path from the position shown to a position adjacent the user's hips, thighs, or knees. This motion may be performed while keeping the arms extended and straight, or while bending the elbows. Such exercises may be performed using simultaneous or alternating strokes, depending on the desired conditioning effect.

Figure 5:
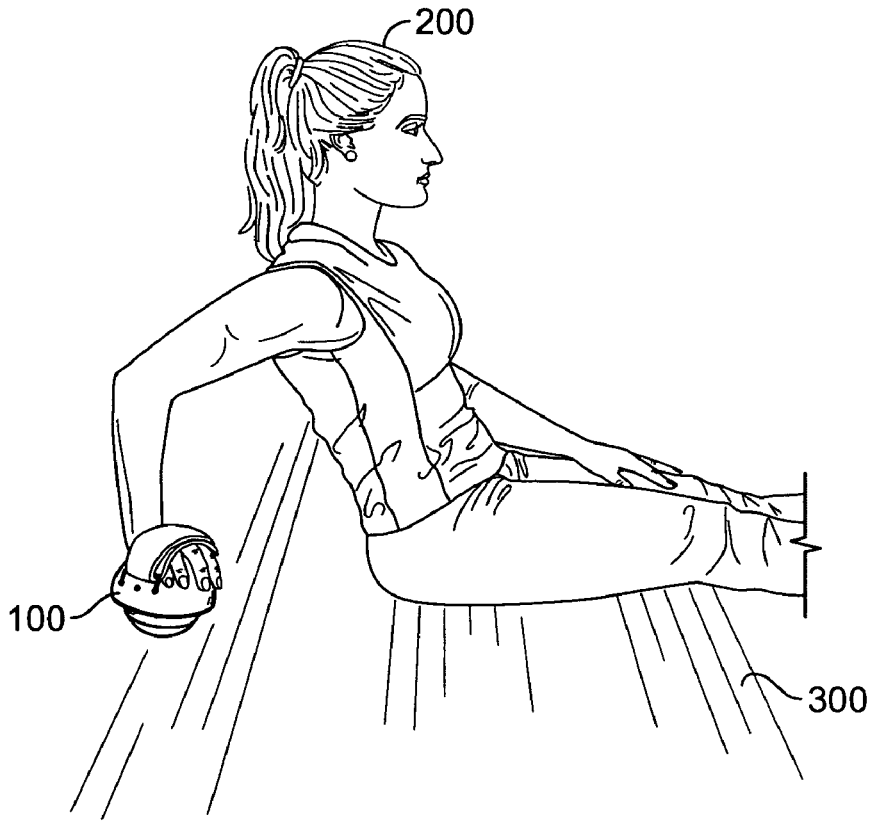
FIG. 5 illustrates a user using a rolling unit to perform another exemplary exercise.
Figure 6:
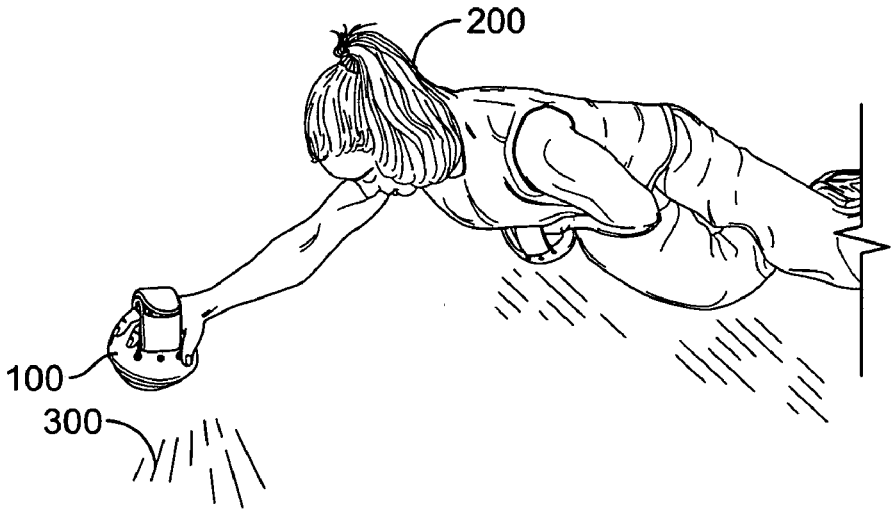
FIG. 6 illustrates a user with a rolling unit in each hand during yet another exemplary exercise.

FIG. 5 shows the user 200 supporting her upper body over surface 300 using a single roller 100 held by her right hand. Such a position may be used during an asymmetric exercise involving twisting of the torso, or just for the exercise of one arm at a time. FIG. 5 also illustrates a bent-arm posture that may be used in either symmetrical or asymmetric exercise. FIG. 6 shows a user 200 in a lateral forward position, supporting her torso over surface 300 using two rollers 100. This position may be used, for example, to perform an exercise by moving the rollers 100 in a crossing pattern. An exercise cycle may comprise, for example, moving the rollers over surface 300 between the position shown and a complementary position, wherein the user's right hand is under her abdomen while the left hand is extended.

Figure 7:
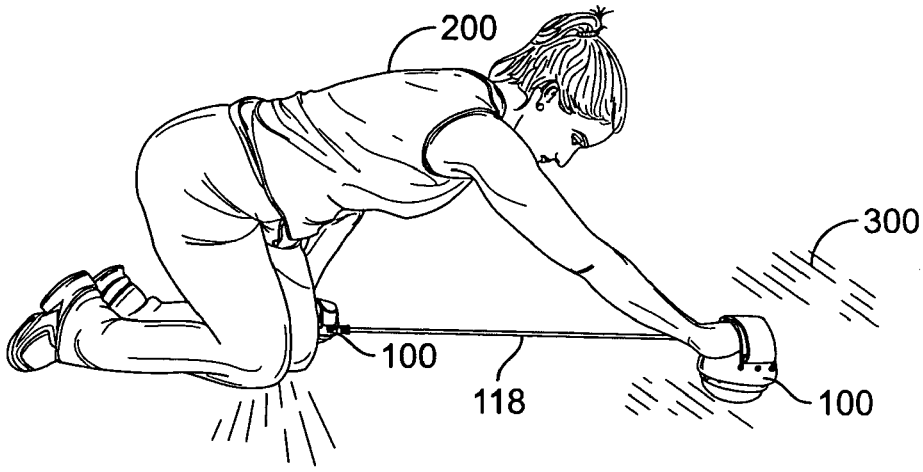
FIG. 7 illustrates a user performing an exercise using rolling units connected by an elastic tether.
Figure 8:
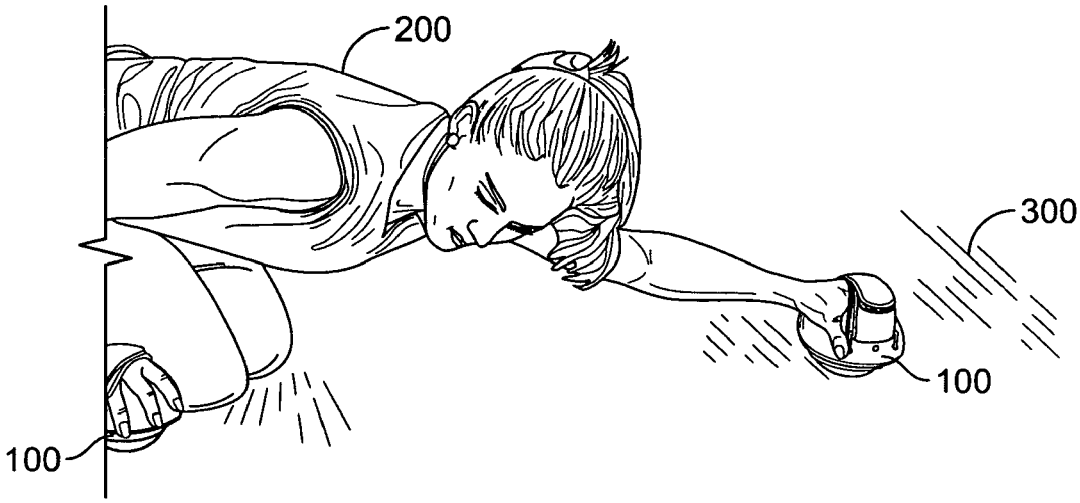
FIG. 8 illustrates a user with a rolling unit in each hand during another exemplary exercise.
Figure 9:
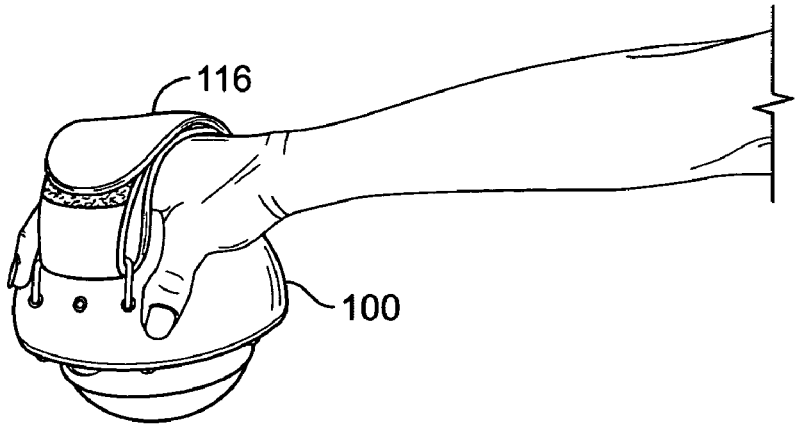
FIG. 9 provides a closer view of a user grasping one embodiment of an omnidirectional rolling unit.

FIG. 7 shows a user 200 in a kneeling position, supporting her upper body over surface 300 by holding two rollers 100 connected by an elastic band 118. The elastic band 118 may help the user maintain a supportable position by keeping the rollers 100 from moving too far apart, and/or may provide horizontal resistance for increased muscle conditioning. FIG. 8 shows user 200 in a similar kneeling position, without an elastic band connecting the rollers 100. FIG. 9 is a close-up view showing an exemplary grip on a roller 100 with a retaining strap 116 over the user's hand. Roller 100 has a generally hemispherical cover sized for gripping by the user. The outer surface of the roller 100 typically comprises a cover made of metal, plastic, or any other suitable known material. In another embodiment (not shown), the roller 100 is at least partially covered with a rubberized outer layer that provides enhanced gripping and comfort.

Figure 10:
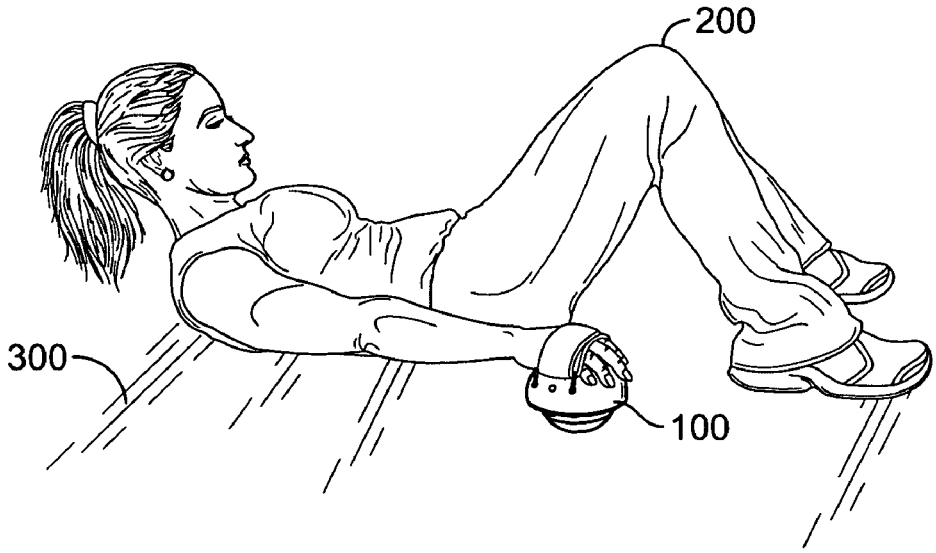
FIG. 10 illustrates a user with a rolling unit during an exemplary exercise method performed while reclined on the back.
Figure 11:
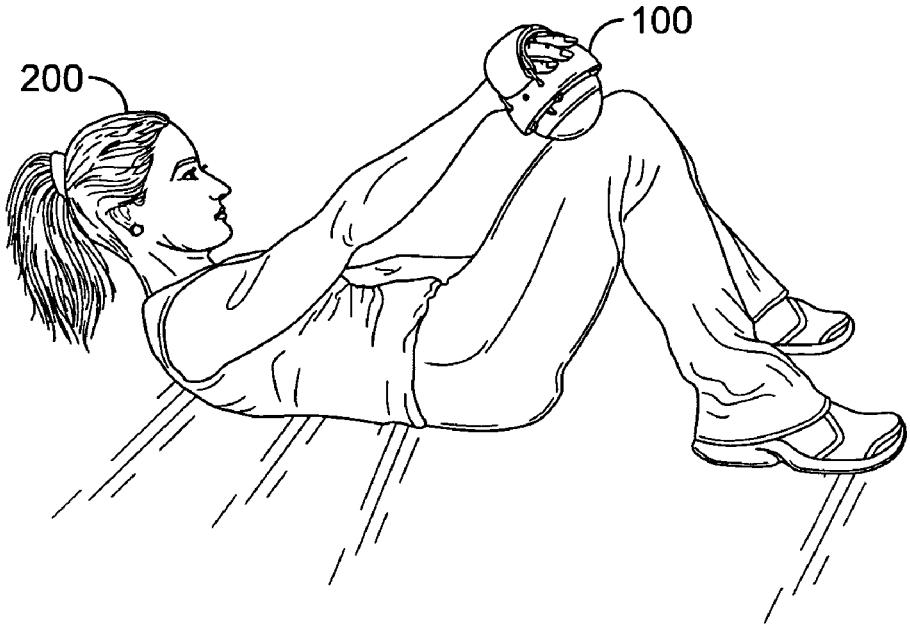
FIG. 11 illustrates one approach to using a rolling unit as a free weight during exercise.
Figure 12:
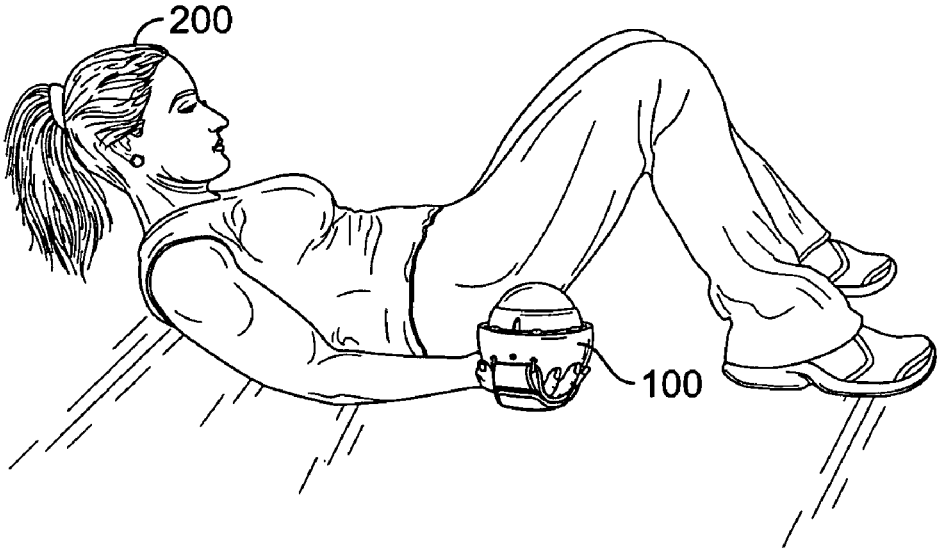
FIG. 12 illustrates another approach to using a rolling unit as a free weight.

FIG. 10 shows the user 200 in a reclining position, with her right arm supported by a unit 100 on surface 300. This position may be used, for example, as a starting position for a free-weight exercise. FIG. 11 shows the user 200 in the same reclining position, using unit 100 as a free weight by lifting it off the floor to the approximate level of her knee. Both rolling and free-weight lifting may be combined in a single exercise cycle. FIG. 12 shows the user 200 using roller 100 as a free weight for performing an arm curl while reclining.

Figure 13:
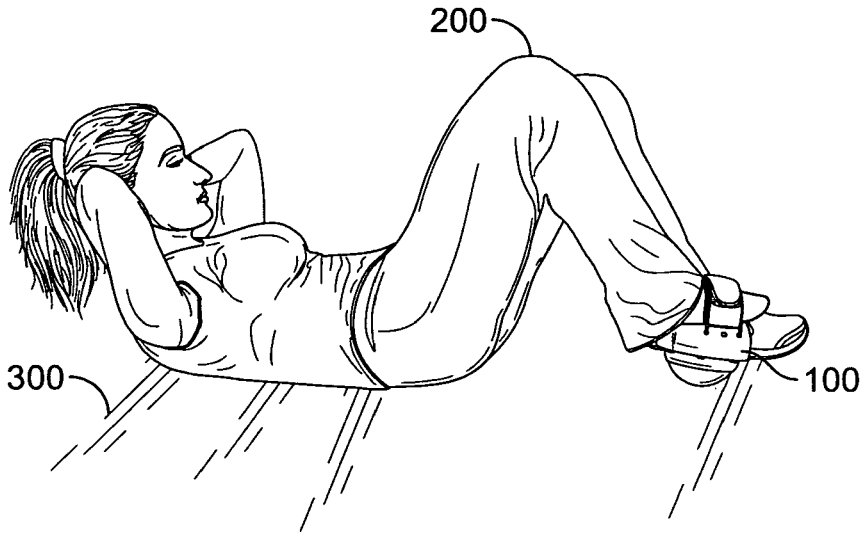
FIG. 13 illustrates one approach to using a rolling unit that is strapped to a user's foot.
Figure 14:
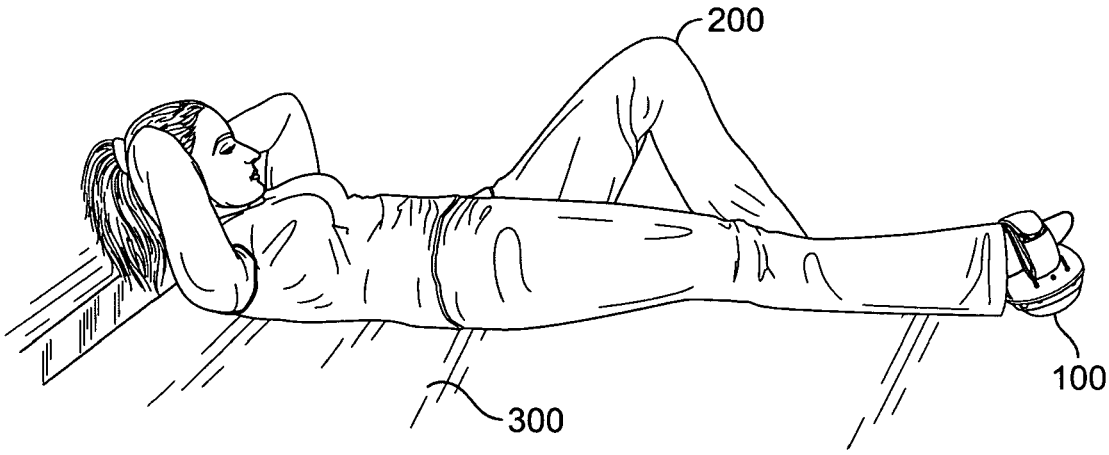
FIGS. 14 and 15 show successive poses of an exercise method that involves using a rolling unit as a leg weight.
Figure 15:
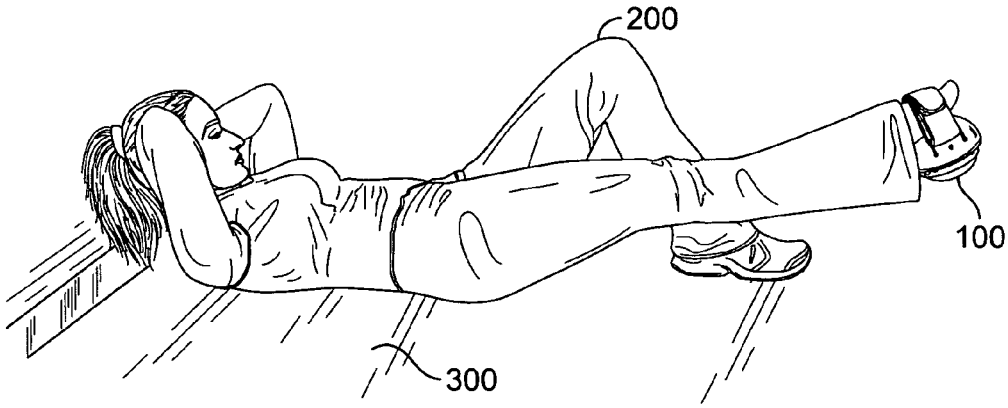
Figure 16:
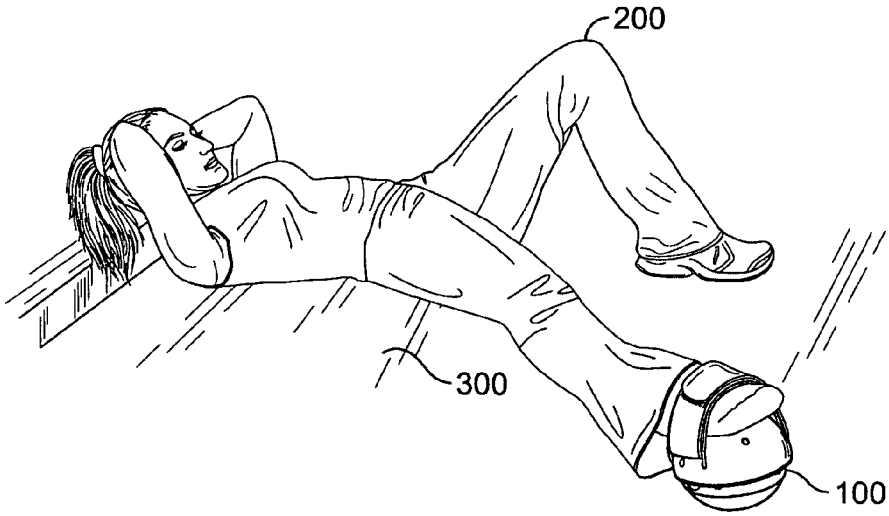
FIG. 16 shows another approach to using a rolling unit that is strapped to a user's foot, in a pose different from those shown in FIGS. 13-15.

FIG. 13 shows the user 200 supporting her right leg over surface 300 by retaining the roller 100 under her right foot while lying on her back. A variety of different motions may be accomplished from this position. FIG. 14 illustrates a position after a leg extension motion from the position shown in FIG. 13. From this extended position, a leg lift motion may be performed, using the roller 100 as a free weight, as shown in FIG. 15. FIG. 16 shows a position of the user after sweeping the leg outwards towards the user's right, while supporting the foot using roller 100. It should be apparent that similar movements may be performed using a roller on the user's left foot, either alone or simultaneously with her right foot.

In summary of the foregoing, a user may use one or more omnidirectional rollers to perform isotonic exercise(s) by supporting a portion of her body over a support surface (e.g., a floor), and using the rolling surface of each roller as a point of support. The user may grip the outer shell of the rolling unit, such as by placing a hand between a restraining strap and an outer shell or cover. In addition, or in the alternative, an omnidirectional roller may be strapped to the user at any other suitable location, such as, for example, the user's foot. Then, while continuing to support a part of her body using each rolling unit, the user may move each rolling unit in any desired path over the support surface.

In particular, the rolling motion may be performed over a curved or angular path, thereby involving a greater number of muscle groups than a linear back-and-forth stroke. For example, a user may move the roller in an elliptical path over the support surface, while using the roller to support her arm. Additional resistance to movement of the omnidirectional roller over the support surface may be provided by an elastic band or other suitable resilient member that is tethered to the roller at one end, and to a fixed point relative to the support surface, or to the user, at an opposite end. In addition, or in the alternative, two or more rollers may be tethered together with an elastic band or other suitable resilient element during exercise.

In addition, the user may lift one or more omnidirectional rollers off of the support surface, using each roller as a free weight during a portion of an exercise cycle. The amount of weight may be adjusted by adding or removing weights from a rolling unit, or by selection of a different roller having a different weight.

Having thus described a preferred embodiment of an apparatus and method for exercising using an omnidirectional roller, it should be apparent to those skilled in the art that certain advantages of the within system have been achieved. It should also be appreciated that various modifications, adaptations, and alternative embodiments thereof may be made within the scope and spirit of the present invention. For example, single-ball omnidirectional rollers have been illustrated, but it should be apparent that the inventive concepts described above would be equally applicable to multi-ball units.

What is claimed is:

1. An omnidirectional rolling apparatus for performing strength training exercises, comprising:

a hemispherical stationary support frame, the frame comprising a top cover and a bottom cover;

a first rigid ball mounted between the top and bottom covers with a low- friction bearing system in between the ball and the top cover, the first ball having a first weight;

a hemispherical outer shell attached to the top cover, the shell having a gripping surface and being dimensioned so that a user can grip the rolling apparatus with one hand; and a strap that is secured to the shell;

wherein the bearing system reduces rolling resistance when the rolling apparatus is loaded over a support surface during exercise;

wherein the first ball is freely rotatable in any direction on the support surface when loaded; and wherein the low-friction bearing system comprises a plurality of ball bearings and a retainer for retaining the ball bearings within the bearing system.

2. The exercise apparatus of claim 1, wherein the strap is configured for attaching the exercise apparatus to one of a human hand or a human foot.

3. The exercise apparatus of claim 1, wherein the first rigid ball is at least partially hollow and is filled with a ballast weight to increase the first weight.

4. The exercise apparatus of claim 1, wherein the lower cover separates from the top cover and the first rigid ball detaches from the support frame.

5. An exercise system, comprising:

a first omnidirectional rolling device, the first device comprising: a first stationary support frame; a first ball securely mounted to the first frame with a first low-friction bearing system; and a first outer shell attached to the first frame, the first shell having a first loop;

a second omnidirectional rolling device, the second device comprising: a second stationary support frame; a second ball securely mounted to the second frame with a second low-friction bearing system; and a second outer shell attached to the second frame, the second shell having a second loop; and an elastic band that connects to the first and second loops of the first and second devices, respectively.

6. The exercise system of claim 5, wherein the first low-friction bearing system comprises a first plurality of ball bearings.

7. The exercise system of claim 5, wherein the second low-friction bearing system comprises a second plurality of ball bearings.

8. The exercise system of claim 5, wherein the first device further comprises a first strap that is secured to the first shell.

9. The exercise system of claim 8, wherein the first strap is configured for attaching the first device to one of a human hand or a human foot.

10. The exercise system of claim 5, wherein the second device further comprises a second strap that is secured to the second shell.

11. The exercise system of claim 10, wherein the second strap is configured for attaching the second device to one of a human hand or a human foot.

* * * * *